US005916031A

United States Patent [19]

Casillan

[11] Patent Number: 5,916,031

[45] Date of Patent: Jun. 29, 1999

[54] DIVING PLATFORM COVER

[76] Inventor: Ramoncito Casillan, 8521 Wave Cir., Huntington Beach, Calif. 92646

[21] Appl. No.: 08/914,044

[22] Filed: Aug. 5, 1997

[51] Int. Cl.[6] ..... A63K 3/02; A63B 5/00

[52] U.S. Cl. ..... 472/85; 482/26; 482/55; 4/503; 4/504

[58] Field of Search ..... 482/23, 26, 30–32, 482/35, 55, 56; 4/488, 496, 498, 503, 504, 582; 472/85, 128; 150/154, 158; 108/97; 52/177

[56] References Cited

U.S. PATENT DOCUMENTS

| | | | |
|---|---|---|---|
| 1,347,510 | 7/1920 | Johnson et al. . | |
| 2,963,294 | 12/1960 | Buck . | |
| 3,003,763 | 10/1961 | Griffith et al. . | |
| 3,035,837 | 5/1962 | Austin . | |
| 3,058,743 | 10/1962 | Gabrielson et al. . | |
| 3,178,333 | 4/1965 | Gabrielsen et al. | 482/30 |
| 3,809,392 | 5/1974 | Kral, Jr. | 482/56 |
| 3,916,214 | 10/1975 | Coble, Jr. et al. | 472/85 |
| 3,942,199 | 3/1976 | Kollsman . | |
| 4,194,101 | 3/1980 | Berseth | 472/85 |
| 5,116,045 | 5/1992 | Jahoda . | |
| 5,423,093 | 6/1995 | Hall-Vandis | 4/504 |

FOREIGN PATENT DOCUMENTS

| | | | |
|---|---|---|---|
| 294787 | 10/1991 | German Dem. Rep. | 482/55 |
| 2301379 | 7/1974 | Germany | 482/30 |

OTHER PUBLICATIONS

Paraflyte Starting Platform, KDI Paragon, Inc. Quality Swimming Pool Equipment 1977 catalog, pp. 14 and 22, 1977.

1988 USMS Rule Book Article 107.11.3, size and slope of starting platform, www.usms.org, 1998.

*Primary Examiner*—Richard J. Apley
*Assistant Examiner*—Victor K. Hwang
*Attorney, Agent, or Firm*—Gene Scott—Patent Law & Venture Group

[57] ABSTRACT

This invention is a slip resistant diving platform cover that can be easily installed or removed from a diving platform. The cover has a top mat laying in contact and covering a top plate of the diving platform, a front mat laying adjacent to a front plate of the diving platform, and a rear mat laying adjacent to a rear plate of the diving platform. These three mats are fastened to the diving platform by a U-shaped front clamp and a U-shaped rear clamp. Both clamps provide a screw means for engagement with the cover and the platform. The front clamp further provides a hinged leg bonded to an interior surface of the cover enabling permanent attachment thereto. The hinged leg preferably has a first portion that is attached to the top mat and a second portion which is attached to the front mat so that the front mat and the top mat may be rotated to an angle appropriate to conforming with the front and top plates of the platform.

5 Claims, 3 Drawing Sheets

DIVING PLATFORM COVER

BACKGROUND OF THE INVENTION

1. Field of the Invention

This invention relates generally to diving platforms, and more particularly to a slip resistant diving platform cover.

2. Description of Related Art

The following art defines the present state of this field:

Johnson, U.S. Pat. No. 1,347,510 describes a portable spring board for diving. This invention has utility when incorporated in diving spring boards.

Buck, U.S. Pat. No. 2,963,294 provides a non-skid deck on metal diving boards. This invention provides a non-skid deck having desired durability and desired safety to the divers.

Griffith et al., U.S. Pat. No. 3,003,763 describes a diving board and mounting means and provides a portable diving board unit which is strong, durable, rugged and compact in construction and which is light in weight and can be easily moved from place to place.

Austin, U.S. Pat. No. 3,035,837 describes a weather-resistant wooden diving board in which a substantial portion of its length adjacent to the free end remains straight and a major portion of its length bends substantially uniformly when the board is loaded, even under varying loads. This invention reduces the dipping of the diving board tip when a concentrated load is placed upon it.

Gabrielson et al., U.S. Pat. No. 3,058,743 describes an improved springboard of the type used in competitive diving events in organized competition and for recreation purposes.

Gabrielson et al., U.S. Pat. No. 3,178,333 describes an invention that relates to springboards of the type used in competitive diving events in organized competition and for recreation purposes and the like. More particularly, this invention relates to a safety mat for the outboard ends of such diving board.

Kollsman, U.S. Pat. No. 3,942,199 describes bathing fixtures, such as bathtubs and shower receptors and devices such as diving boards and surfboards are provided with a contoured surface. At least within an area on which a person normally sits or stands, to provide within such area a great number of alternate, raised and depressed surface portions bounded by sharp edges, which break down skip-promoting liquid film.

Jahoda, U.S. Pat. No. 5,116,045 describes a sports mat, especially a judo mat of an elastic foam-like material and possibly a sheath. According to the invention, the elastic foam-like material is arranged on a stiff approximately circular plate, which has a central projection on the underside and is fitted so as to "float" on a yielding foam.

The prior art teaches diving platforms and the use of a non-slip surface in conjunction with diving springboards. However, the prior art does not teach a detachable diving platform cover. The present invention can be easily locked into place over a diving platform for safe and secure diving. After use, the invention can be quickly and easily removed without any complex tools. The present invention fulfills the need for an easily modified diving platform and provides further related advantages as described in the following summary.

SUMMARY OF THE INVENTION

The present invention teaches certain benefits in construction and use that give rise to the objectives described below.

The present invention provides a diving platform cover for covering a diving platform. The cover is composed of a top mat laying in contact and covering a top plate of the diving platform, a front mat laying adjacent to a front plate of the diving platform, and a rear mat laying adjacent to a rear plate of the diving platform.

These three mats are fastened to the diving platform by a clamping means removably engaging the front mat with the front plate and the rear mat with the rear plate so that the cover is immovable on the diving platform. The clamping means is preferably both a front clamp and a rear clamp. The front clamp can be U-shaped and provides a first screw means for engagement with the cover and the platform. The rear clamp can be U-shaped and provides a second screw means for engagement with the cover and the platform. In its best mode, the front clamp further provides a hinged leg bonded to an interior surface of the cover enabling permanent attachment thereto. The hinged leg can have a first portion which is attached to the top mat and a second portion which is attached to the front mat so that the front mat and the top mat may be rotated to an angle appropriate to conforming with the front and top plates of the platform.

A primary objective of the present invention is to provide a diving platform cover that can be securely attached to a diving platform during use, but also easily removed when not in use. This invention provides this ability, and offers the user advantages not taught by the prior art.

Another objective of the invention is to provide a diving platform cover that completely covers the diving platform, providing the diver with both a non-slip surface as well as protection from the diving platform in case of a fall.

A further objective is to provide a brightly colored diving platform. A brightly colored cover for the diving platform not only provides visual safety, it also adds color to competitive swimming events. It is also possible to print the logos of either the team or its sponsors on the platform covers. By providing for easy removal of the covers, it is possible to store the covers out of the sun when not in use, greatly extending the life-span of the covers and preserving the colors and logos from fading.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
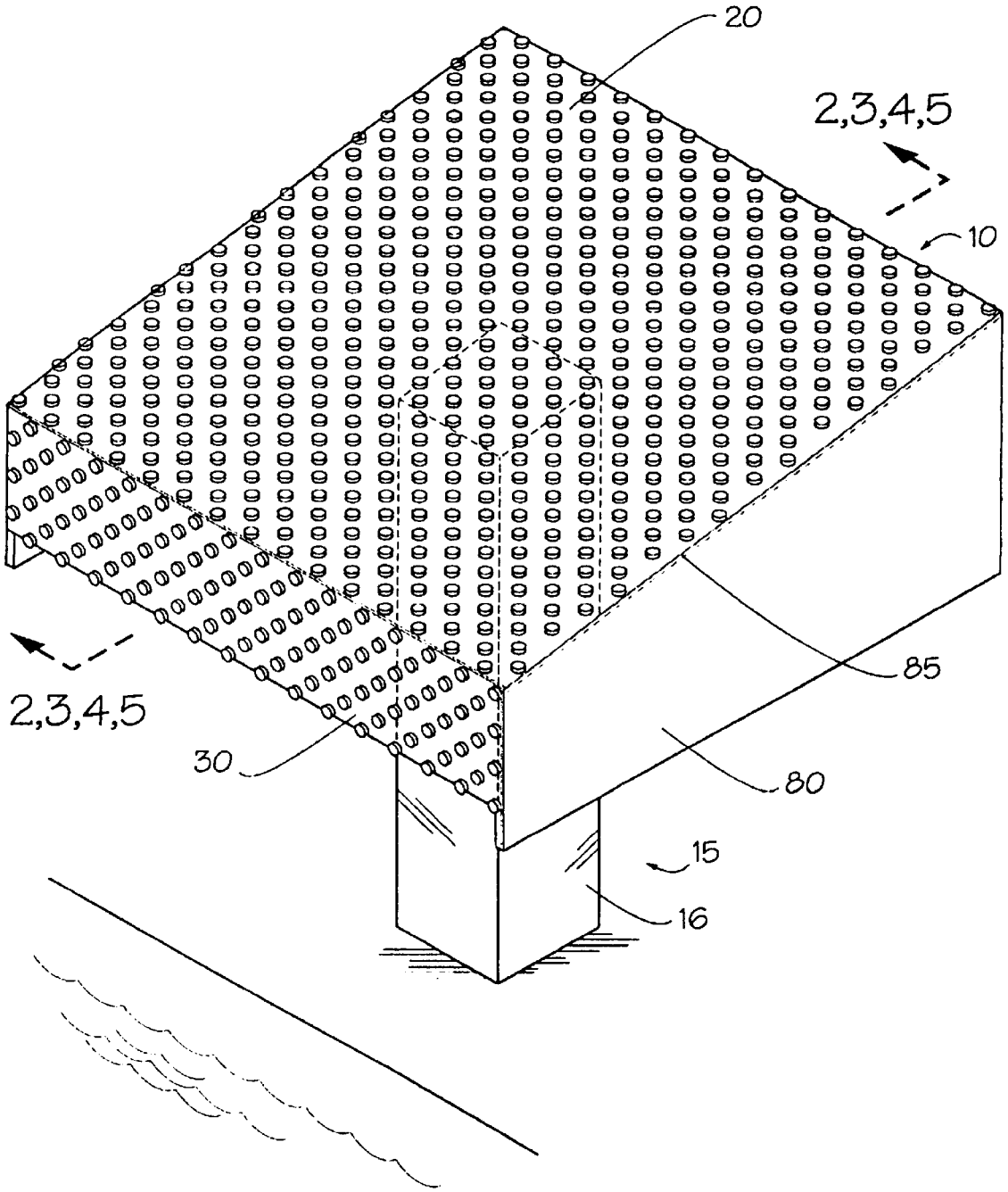
FIG. 1 is a perspective view of the preferred embodiment of the present invention shown mounted onto a diving platform.

The above described drawing figures illustrate the invention, a diving platform cover 10 for covering a diving platform 15. A diving platform 15 typically consists of a top plate 25 supported one or two feet above the ground by a post 16 planted into the deck near the edge of a swimming pool (not shown). A front plate 35 extends downward from the edge of the top plate 25 which is closest to the pool, and a rear plate 45 extends downward from the edge of the top plate 25 which is furthest from the pool. The top plate is supported in a generally horizontal position but tilted towards the pool to give the user greater traction when diving from the platform.

The diving platform cover 10 has a top mat 20 with a top interior surface 22. When in use, the top mat 20 lies in contact with and covers the top plate 25 of the diving platform 15. The top interior surface 22 is preferably textured or roughened so that it maintains firm contact with the top plate 25 when in use, so that the diving platform cover 15 does not slide when the diver dives off the diving platform 15. The diving platform cover 10 also has a front mat 30 having a front interior surface 32. The front mat lies adjacent to a front plate 35 of the diving platform 15. The cover also has a rear mat 40 which lies adjacent to a rear plate 45 of the diving platform 15. The top, front and rear mats are contiguously and integrally interconnected for covering the prominent surfaces of the diving platform 15. In its best mode, the top mat is twenty three and three-quarters inches wide (23¾"+/−1"); and it is nineteen and one-half inches deep (19½"+/−1"). The front and rear mats are both one and ¾ inches (1¾") long. These three mats are fastened to the diving platform 15 by a clamping means removably engaging the front mat 30 with the front plate 35 and the rear mat 40 with the rear plate 45 so that the diving platform cover 10 is immovable on the diving platform 15. The clamping means preferably provides and includes a front clamp 50 and a rear clamp 60.

Figures 2, 3:
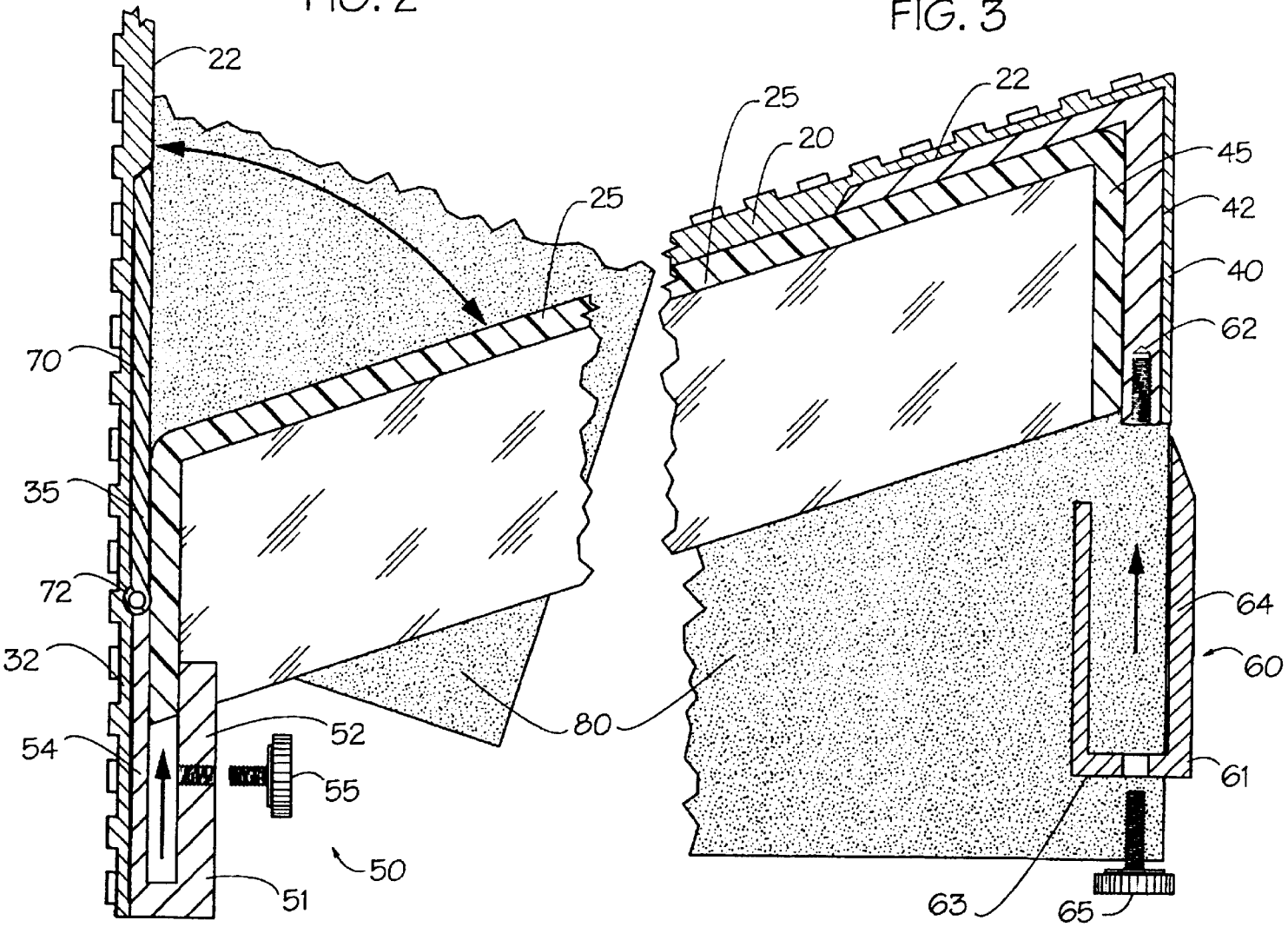
FIG. 2 is a partial sectional view taken along line 2—2 in FIG. 1 and showing a front portion thereof as well as a front portion of the diving platform, the invention being installed thereon.
FIG. 3 is a partial sectional view taken along line 3—3 in FIG. 1 and showing a rear portion thereof as well as a rear portion of the diving platform, the invention being installed thereon.
Figures 4, 5:
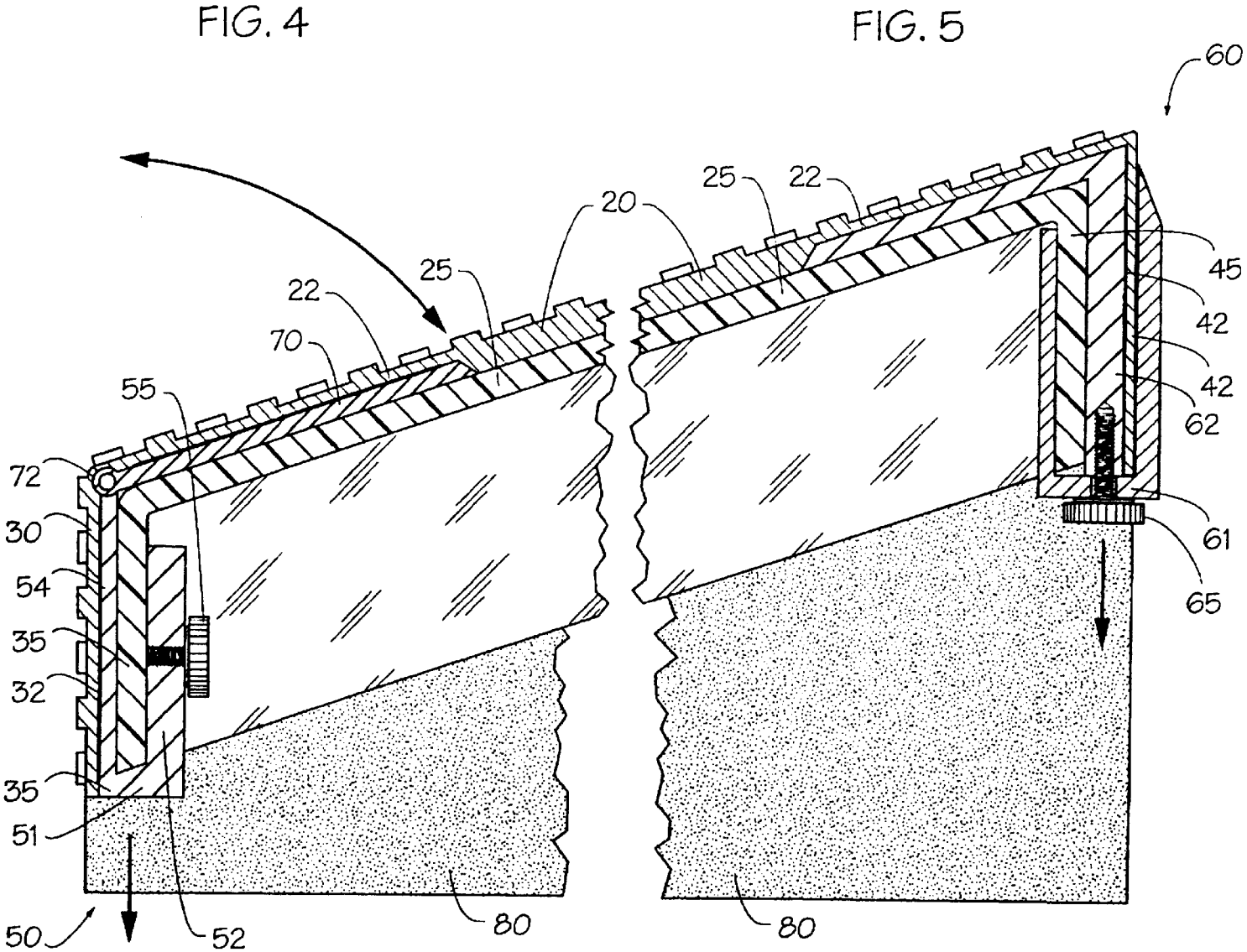
FIG. 4 is a partial sectional view taken along line 4—4 in FIG. 1 and showing a front portion thereof as well as a front portion of the diving platform, the invention installed thereon.
FIG. 5 is a partial sectional view taken along line 5—5 in FIG. 1 and showing a rear portion thereof as well as a rear portion of the diving platform, the invention installed thereon.

The front clamp 50 preferably includes a front U-shaped vice 51 and a first screw means 55. The front U-shaped vice 51 has a first arm 52 and a second arm 54 set apart by approximately the thickness of the front plate 35. As shown in FIG. 2, the front U-shaped vice 51 is configured to engage the front plate 35 by sliding onto it from below so that the front plate 35 is sandwiched between the arms 52 and 54 of the front clamp 50. The second arm 54 is permanently attached to the front interior surface 32. The first screw means 55 passes through and threadedly engages the first arm 52. The first screw means 55 and the second arm 54 in combination form a vice such that when the screw is tightened the first screw means 55 and the second arm 54 firmly clamp the front plate 35.

In its best mode, the front clamp 50 further provides a hinged leg 70 attached at a hinge 72 to the front U-shaped vice 51 and bonded to the top interior surface 22 enabling permanent attachment thereto. The hinged leg 70 allows the front mat 30 and the top mat 20 to be rotated to an angle appropriate to conforming with the front plate 35 and top plate 25 of the diving platform 15.

The rear clamp 60 preferably includes a rear U-shaped lock 61 with a second screw means 65 and a screw receiving means 62. The rear U-shaped lock 61 has an inner arm 63 and an outer arm 64, set apart by approximately the thickness of the rear plate 45, the screw receiving means 62, and the rear mat 40. The screw receiving means 62 is permanently attached to the rear interior surface 42. The screw receiving means 62 can also extend in an L-shape which is also permanently attached to the top interior surface 22. As shown in FIG. 3, the rear clamp 60 is configured to engage the rear plate 45, the screw receiving means 62 and the rear mat 40 by sliding onto them from below so that all three components are sandwiched between the inner arm 63 and the outer arm 64. In its preferred embodiment, the second screw means 65 includes a screw which penetrates and threadedly engages the rear U-shaped lock 60 and threadedly engages the screw receiving means 62.

The front clamp 50 and the rear clamp 60 work in conjunction to provide a diving platform cover 10 that can be securely attached to a diving platform during use, but also easily removed when not in use. This capability offers the user advantages not taught by the prior art, and meets the first objective of this invention.

The diving platform cover 10 can also include two side mats 80 that are integrally molded to the top mat 20. The side mats 80 and the top mat 20 meet to form right angles 85 at the junction of the two pieces; however, these side mats 80 are not essential for the invention to function. The diving platform 15 is preferably composed of a textured rubber-like surface such as rubber, neoprene, synthetic rubber, latex, plastic, or a similar material that is slip resistant and preferably somewhat impact absorbing. This no-slip and protective surface completely covering the diving platform 10 offers advantages not taught by the prior art and meets another object of this invention.

The surface of the diving platform cover 10 can be painted, stained, or otherwise colored with bright and visually pleasing colors, designs, logos and advertisements. Since the diving platform cover 10 can then be removed from the diving platform 15 and stored when not in use, the coloring, designs and logos will not fade in the sun. This allows for brightly colored logos and advertisements to be displayed during competitive events but which are not destroyed by the elements between events. This capability is not taught by the prior art, and meets the final objective of this invention.

The invention also includes the method of attaching the diving platform cover 10 to the diving platform 15. The method includes several steps. First, the invention calls for providing the diving platform cover 10 as previously described. Second, the front U-shaped vice 51 is engaged with the front plate 35 by sliding the front U-shaped vice 51 over the front plate 35 and sandwiching the front plate 35 between the first arm 52 and the second arm 54. This brings the front mat 30 into adjacency with the front plate 35. Third, the first screw means 55 is inserted through and threadedly engaged to the first arm 52. The first screw means 55 and the second arm 54 in combination form a vice such that when the screw is tightened these two elements firmly clamp the front plate 35. Fourth, once the front U-shaped device 51 is installed, the hinge 72 is positioned at the juncture between the top plate 25 and the front plate 35, allowing the hinged leg 70 and the top mat 20 to fall down and into full contact with the top plate 25. This also brings the rear mat 40 and the screw receiving means 62 into contact with the top plate 25 and the rear plate 45. Fifth, the rear clamp 60 is installed from below around the screw receiving means 62, the rear mat 40, so that the inner arm 63 and the outer arm 64 form a sandwich around all three components. Sixth, the second screw means 65 is screwed through the rear U-shaped lock 60 and threadedly engaged with screw receiving means 62.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A diving platform cover for covering a diving platform, the cover comprising:

a top mat for laying in contact and covering a top plate of the diving platform;

a front mat for laying adjacent to a front plate of the diving platform;

a rear mat for laying adjacent to a rear plate of the diving platform; and a clamping means for removably engaging the front mat with the front plate and the rear mat with the rear plate so that the cover is immovably installable on the diving platform;

the clamping means providing at least one hinged leg for adapting the diving platform cover for attachment to the diving platform;

the top, front and rear mats being contiguous and interconnected for covering the diving platform top, front and rear plates respectively.

2. The cover of claim 1 wherein the clamping means comprises, separately, a front clamp and a rear clamp.

3. The cover of claim 2 wherein the front clamp provides a first screw means for engagement with the cover and the platform, the first screw means being positioned for tightening from within the platform.

4. The cover of claim 2 wherein the rear clamp provides a second screw means for engagement with the cover and the platform, the second screw means being positioned for tightening from below the platform.

5. The cover of claim 2 wherein the hinged leg is bonded to an interior surface of the cover enabling permanent attachment thereto, a first portion of the hinged leg is attached to the top mat, and a second portion of the hinged leg is attached to the front mat so that the front mat and the top mat may be rotated to an angle appropriate to conforming with the front and top plates of the platform.

* * * * *